US010468817B1

(12) United States Patent
Lee et al.

(10) Patent No.: US 10,468,817 B1
(45) Date of Patent: Nov. 5, 2019

(54) HOUSING DEVICE WITH SLIDABLE ENGAGEMENT

(71) Applicant: Chicony Power Technology Co., Ltd., New Taipei (TW)

(72) Inventors: Chen-Liang Lee, New Taipei (TW); Yu-Cheng Liu, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/148,117

(22) Filed: Oct. 1, 2018

Related U.S. Application Data

(60) Provisional application No. 62/663,462, filed on Apr. 27, 2018.

(30) Foreign Application Priority Data

Aug. 7, 2018 (TW) ..... 107127514 A

(51) Int. Cl.
*H01R 13/58* (2006.01)
*H01R 13/502* (2006.01)
*H01R 103/00* (2006.01)
*H01R 24/28* (2011.01)

(52) U.S. Cl.
CPC ..... *H01R 13/5812* (2013.01); *H01R 13/502* (2013.01); *H01R 13/5816* (2013.01); *H01R 24/28* (2013.01); *H01R 2103/00* (2013.01)

(58) Field of Classification Search
CPC ..... H01R 13/5816; H01R 13/5812
See application file for complete search history.

(56) References Cited

U.S. PATENT DOCUMENTS 4,416,503 A * 11/1983 Hayes ..... F16B 2/10 174/135
4,516,822 A * 5/1985 Wolfel ..... H01R 13/5812 439/425
5,021,610 A * 6/1991 Roberts ..... H01R 13/5812 174/135
5,445,538 A * 8/1995 Rodrigues ..... H01R 13/5812 439/460
6,123,573 A * 9/2000 Savicki, Jr. ..... H01R 13/5812 439/466
6,139,355 A * 10/2000 Puerner ..... H01R 13/516 439/468

(Continued)

FOREIGN PATENT DOCUMENTS

CN 201131098 10/2008
CN 204243336 U 4/2015

(Continued)

*Primary Examiner* — James Harvey
(74) *Attorney, Agent, or Firm* — Innovation Capital Law Group, LLP; Vic Lin

(57) ABSTRACT

A housing device with slidable engagement includes a housing body, a fitting, and a sliding buckle. The housing body includes an opening side and a lateral adjacent to the opening side. The lateral has a through hole, and an inner surface of the lateral is provided with a guide structure. The fitting is inserted into the housing body through the through hole. The sliding buckle is slidably assembled on the guide structure. The sliding buckle includes two clamping arms, and the two clamping arms correspondingly clamp to an outside of the fitting.

13 Claims, 12 Drawing Sheets

(56) References Cited

U.S. PATENT DOCUMENTS

| | | | | |
|---|---|---|---|---|
| 6,641,429 | B1 * | 11/2003 | Wu | H01R 9/032 439/465 |
| 8,891,929 | B2 | 11/2014 | Fariello et al. | |
| 2005/0155783 | A1 * | 7/2005 | Da Silva | H01R 13/5804 174/650 |
| 2007/0278357 | A1 * | 12/2007 | Pizzi | F16L 3/1025 248/74.1 |
| 2010/0101285 | A1 | 4/2010 | Hsu | |
| 2012/0264324 | A1 * | 10/2012 | Stein | H01R 13/508 439/345 |
| 2017/0290183 | A1 | 10/2017 | Lee et al. | |

FOREIGN PATENT DOCUMENTS

| | | | |
|---|---|---|---|
| TW | 297082 | B | 2/1997 |
| TW | 573756 | U | 2/2004 |
| TW | M502196 | U | 6/2015 |
| TW | M531692 | U | 11/2016 |
| TW | 201735768 | A | 10/2017 |

* cited by examiner

HOUSING DEVICE WITH SLIDABLE ENGAGEMENT

CROSS-REFERENCES TO RELATED APPLICATIONS

This application claims the priority benefit of U.S. provisional application Ser. No. 62/663,462, filed on Apr. 27, 2018 and Patent Application No. 107127514 filed in Taiwan, R.O.C. on Aug. 7, 2018. The entirety of the above-mentioned patent applications are hereby incorporated by references herein and made a part of the specification.

BACKGROUND

Technical Field

The instant disclosure relates to a housing device, in particular, to a housing device with slidable engagement.

Related Art

In general, the housings of many electrical and electronic apparatuses (e.g., power supplies, wired keyboards, and wired mice) are adapted to connect to external cables or other accessories. Taking the power supply as an example, normally, a power supply has a housing and a power output cable inserted into the housing from outside for electrically connected to a circuit board in the housing. In order to prevent the power output cable from being detached off the housing due to improper pulling operation, a cable buckle is assembled between the housing and the power output cable, so that the power output cable can be buckled on the housing by the cable buckle.

Regarding the assembly of a cable buckle known to the inventor, an operator holds the cable buckle and inserts the cable buckle into the housing, so that the cable buckle is correspondingly buckled with the power output cable inserted from outside. However, under such operation, the operator cannot perform the assembly easily because he or she may be hard to apply force properly for the assembly. Furthermore, for those power supplies with the power output cables located at the interior portion of a housing, the operators need special fixtures for the assembly.

SUMMARY

In view of this, in one embodiment, a housing device with slidable engagement is provided and the housing device with slidable engagement comprises a housing body, a fitting, and a sliding buckle. The housing body comprises an opening side and a lateral adjacent to the opening side. The lateral has a through hole, and an inner surface of the lateral is provided with a guide structure. The fitting is inserted into the housing body through the through hole. The sliding buckle is slidably assembled on the guide structure. The sliding buckle comprises two clamping arms, and the two clamping arms correspondingly clamp to an outside of the fitting.

As above, according to one or some embodiments of the instant disclosure, the sliding buckle is slidably assembled with the guide structure to fix or to release the fitting, so that the assembly of the housing device with slidable engagement can be performed in a convenient, rapid, and easy manner. For example, when the fitting is located at the interior portion of the housing body, the operator cannot insert his or her hands into the housing body for performing the assembly, and the operator may need special fixtures for the assembly; while in this embodiment, the operator just needs to apply force to operate the sliding buckle sliding toward the fitting for achieving the rapid assembly of the fitting with the housing body. Accordingly, since the operator does not need any additional tools for the assembly of the housing device with slidable engagement, the production cost of the housing device with slidable engagement can be reduced and the assembly steps can be simplified.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
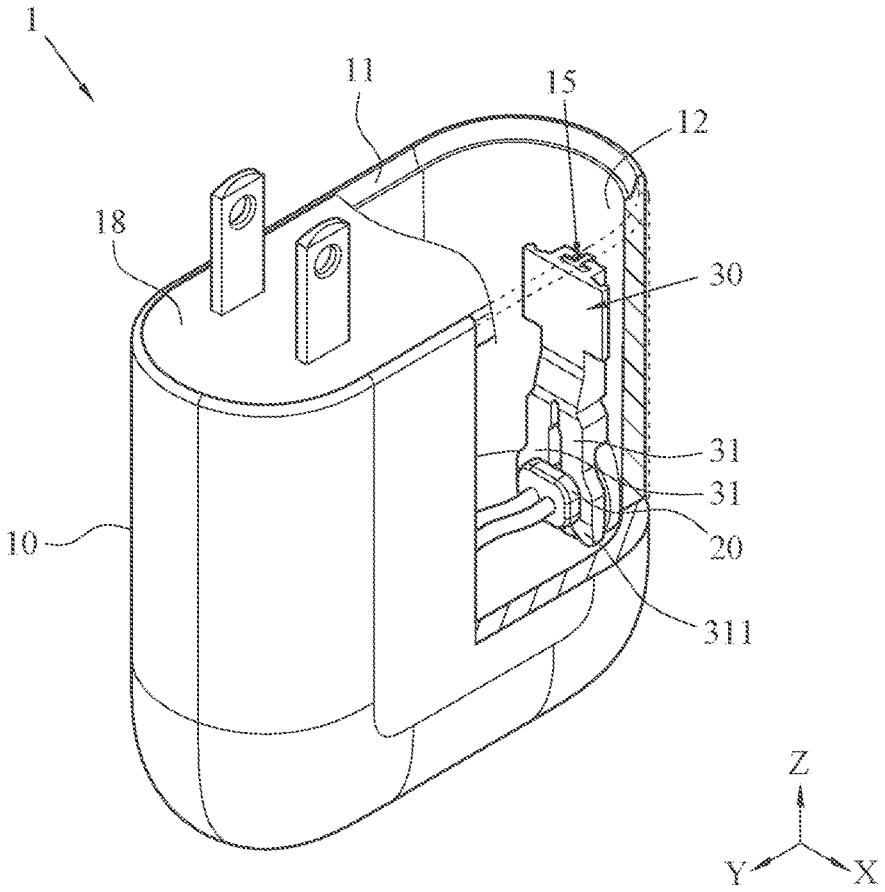
FIG. 1 illustrates a perspective view of a housing device with slidable engagement according to a first embodiment of the instant disclosure.
Figure 2:
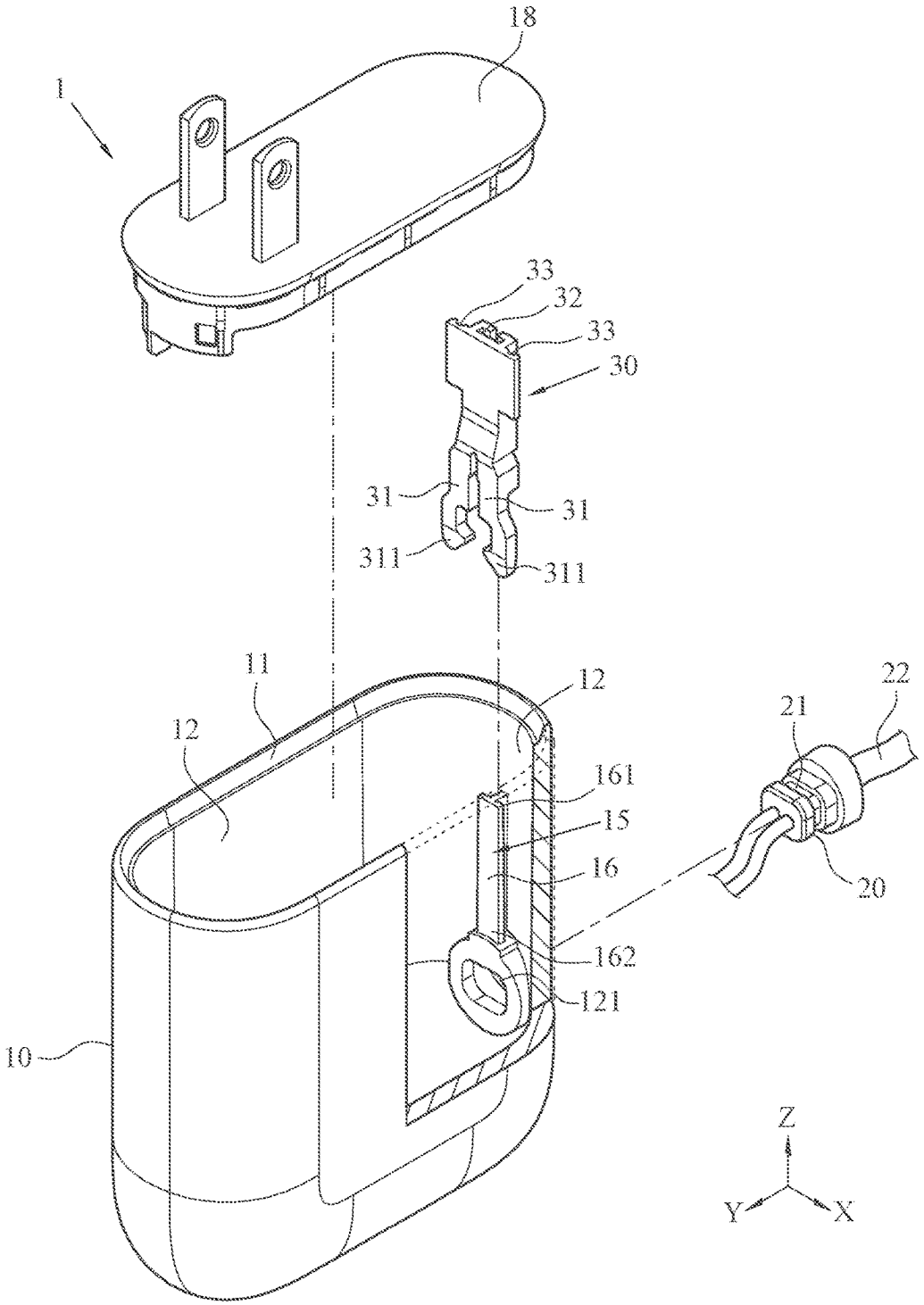
FIG. 2 illustrates an exploded view of the housing device with slidable engagement according to the first embodiment.

FIGS. 1 to 4 respectively illustrate a perspective view, an exploded view, an assembled view, and a sectional view of a housing device with slidable engagement according to a first embodiment of the instant disclosure. As shown in FIGS. 1 and 2, the housing device with slidable engagement 1 comprises a housing body 10, a fitting 20, and a sliding buckle 30. The housing device with slidable engagement 1 may be the housing of different electrical and electronic apparatuses (e.g., power supplies, wired mice, and computers). In this embodiment, the housing device with slidable engagement 1 is the housing of a power supply, but embodiments are not limited thereto.

As shown in FIGS. 1 and 2, the housing body 10 of the housing device with slidable engagement 1 is a hollow housing for accommodating different components. The housing body 10 comprises an opening side 11 and a lateral 12 adjacent to the opening side 11. The opening side 11 is one side of the housing body 10 and is open. Therefore, an external component (e.g., a circuit board) can be assembled inside the housing body 10 through the opening side 11. After the component is assembled in the housing body 10, a cover 18 is assembled to the opening side 11 to allow the housing body 10 to be in a closed state.

As shown in FIGS. 1 and 2, the housing body 10 may have several laterals 12 connected to the opening side 11. In this embodiment, one of the laterals 12 has a through hole 121, and an inner surface of the lateral 12 having the through hole 121 is further provided with a guide structure 15. The guide structure 15 may be any kinds of linear rails. As shown in FIG. 2, in this embodiment, the guide structure 15 is a linear sliding rail 16 with a T-shaped cross section, and the sliding rail 16 has a first end 161 and a second end 162 opposite to the first end 161. Further, the first end 161 of the sliding rail 16 is adjacent to the opening side 11, and the second end 162 of the sliding rail 16 is adjacent to the through hole 121. In some other embodiments, the cross section of the sliding rail 16 may be in other shapes, for example, L shapes, dovetail shapes, or other irregular shapes. Alternatively, the sliding rail 16 may be a rail with a recessed shape, but embodiments are not limited thereto.

As shown in FIGS. 1 and 2, in some embodiments, the sliding rail 16 may be assembled on the inner surface of the lateral 12. For example, when the housing body 10 is a plastic shell, the sliding rail 16 may be a plastic rail or a metal rail, and the rail may be assembled on the inner surface of the lateral 12 of the housing body 10 through adhering, hot-melting, locking, or other ways. Alternatively, the sliding rail 16 and the housing body 10 may be an integrated structure. For example, the sliding rail 16 and the housing body 10 are formed as an integral component by injection moulding.

As shown in FIGS. 1 and 2, through the through hole 121, the fitting 20 is inserted into the housing body 10 from outside. In this embodiment, the fitting 20 is a cable strain relief. For example, the fitting 20 may be fixed with an end portion of a power output cable 22 and then inserted into the housing body 10 through the through hole 121. In other embodiments, the fitting 20 may be a cable strain relief of other kinds of cables (e.g., signal cables). Alternatively, the fitting 20 may be an end portion of the cable. In a further option, the fitting 20 may be one of other components, but embodiments are not limited thereto.

As shown in FIGS. 1 and 2, in one embodiment, the sliding buckle 30 is a rigid block. For example, the sliding buckle 30 may be formed as an integral component by plastic injection moulding, but embodiments are not limited thereto. Further, the sliding buckle 30 is slidably assembled with the guide structure 15, so that the sliding buckle 30 is slidable relative to the guide structure 15 to buckle on or release off the fitting 20 inserted through the through hole 121. In this embodiment, the sliding buckle 30 is provided with a sliding groove 32 corresponding to the sliding rail 16 (here, the cross section of the sliding rail 16 is T-shaped, and the cross section of the sliding groove 32 is also T-shaped corresponding to the sliding rail 16, but embodiments are not limited thereto). The sliding buckle 30 is slidably assembled with the sliding rail 16 by the sliding groove 32, so that the sliding buckle 30 can be moved linearly relative to the sliding rail 16 (for example, in this embodiment, the sliding buckle 30 can be moved along the Z-axis direction). Moreover, the assembly between the sliding rail 16 and the sliding groove 32 allows the sliding buckle 30 to be limited in the X-axis direction and the Y-axis direction to prevent the sliding buckle 30 from being detached from the guide structure 15 easily. Furthermore, one end of the sliding buckle 30 adjacent to the through hole 121 comprises two clamping arms 31, and the two clamping arms 31 correspondingly clamp to the outside of the fitting 20, so that the fitting 20 can be fixed on the housing body 10. In the following, the assembly details of the housing device with slidable engagement 1 are described accompanied with figures.

Figure 3:
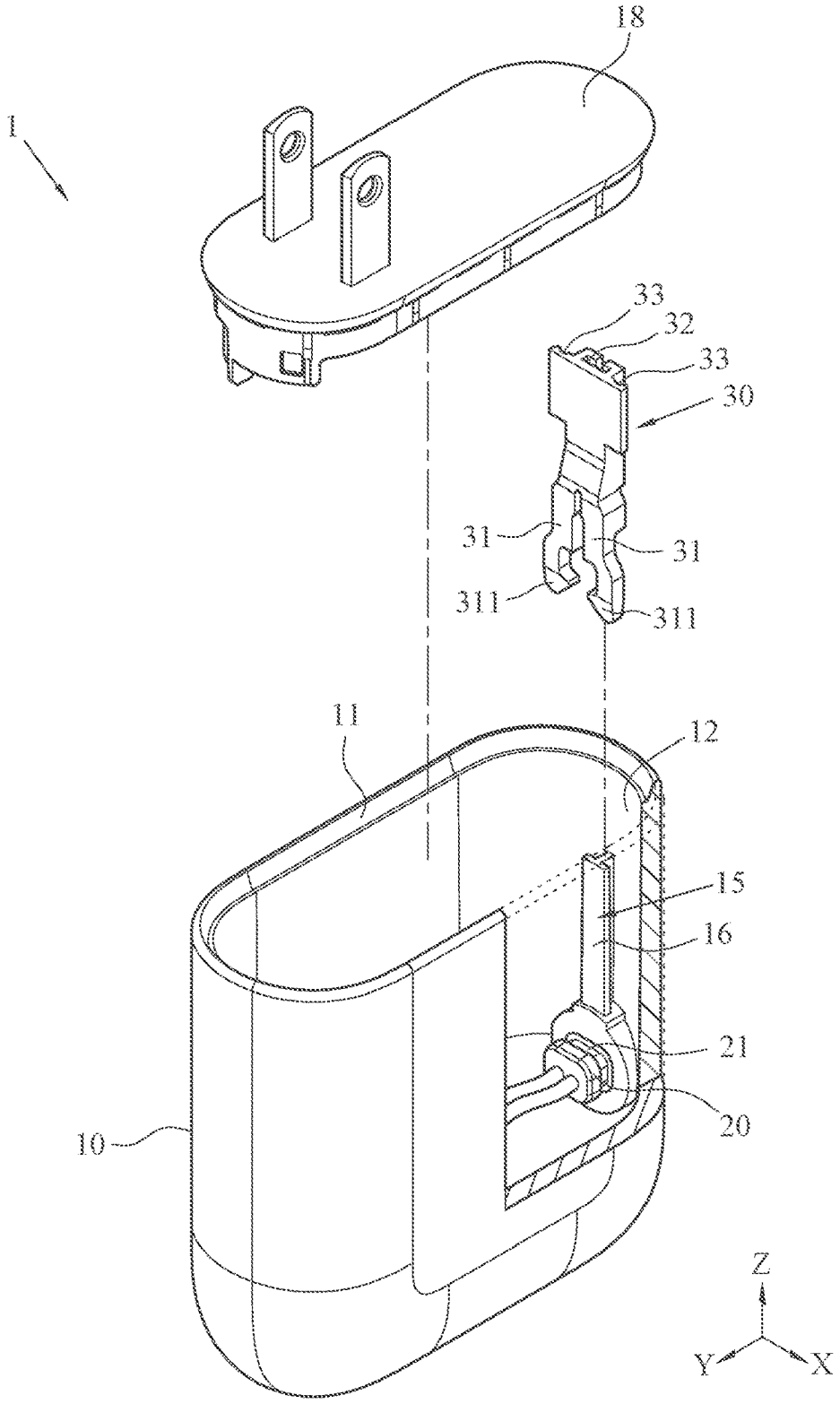
FIG. 3 illustrates an assembled view of the housing device with slidable engagement according to the first embodiment.
Figure 4:
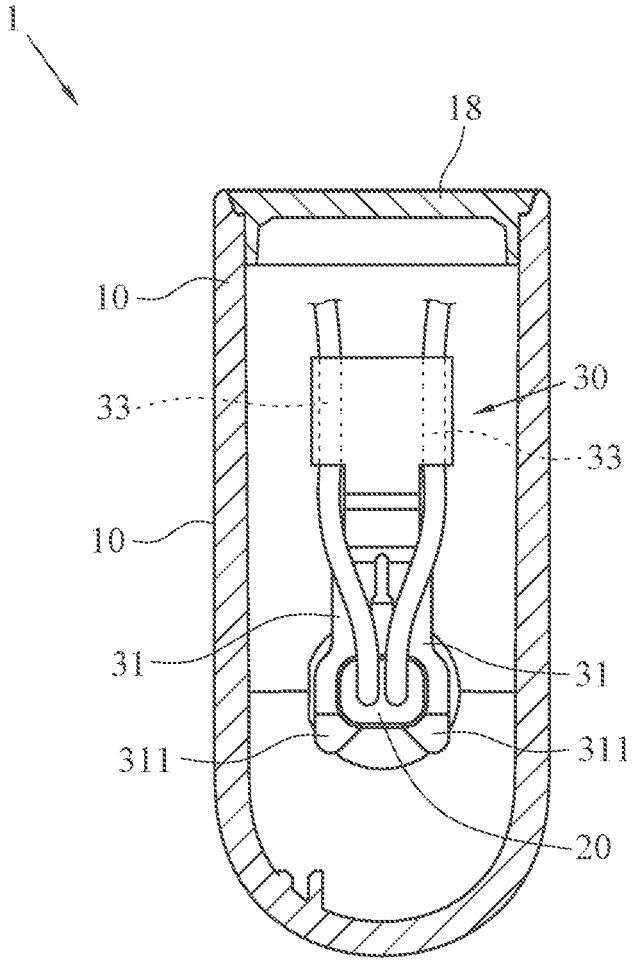
FIG. 4 illustrates a sectional view of the housing device with slidable engagement according to the first embodiment.

As shown in FIGS. 2 and 3, in the assembly procedure, firstly, an operator can insert the fitting 20 into the housing body 10 through the through hole 121, then insert the sliding buckle 30 into the housing body 10 from the opening side 11, and assemble the sliding buckle 30 with the sliding rail 16 by the sliding groove 32. Accordingly, one end of the sliding buckle 30 having the two clamping arms 31 is adjacent to the fitting 20. Next, the operator can apply force to operate the sliding buckle 30 (e.g., the operator may push one end of the sliding buckle 30 adjacent to the opening side 11) continuously sliding toward the fitting 20, along the sliding rail 16. Therefore, the two clamping arms 31 of the sliding buckle 30 are forced and expanded outwardly for correspondingly clamping to the outside of the fitting 20. As a result, the fitting 20 can be fixed in the housing body 10 (as shown in FIGS. 1 and 4), and the fitting 20 can be prevented from being detached from the housing body 10 due to improper pulling operation. Conversely, when the fitting 20 is to be detached from the housing body 10, the operator can apply force to operate the sliding buckle 30 sliding away from the fitting 20. For example, the operator can hold one end of the sliding buckle 30 adjacent to the opening side 11 and apply force to the sliding buckle 30 in a direction away from the fitting 20, so that the sliding buckle 30 can be detached from the fitting 20.

Therefore, in this embodiment, the sliding buckle 30 is slidably assembled with the guide structure 15 to fix or to release the fitting 20, so that the assembly of the housing device with slidable engagement 1 can be performed in a convenient, rapid, and easy manner. For example, when the fitting 20 is to be assembled in the interior portion of the housing body 10, the operator cannot insert his or her hands into the housing body 10 for performing the assembly, and the operator may need special fixtures for the assembly; while in this embodiment, the operator just needs to apply force to operate the sliding buckle 30 sliding toward the fitting 20 for achieving the assembly of the fitting 20 with the housing body 10 in a rapid manner. Accordingly, since the operator does not need any additional tools for the assembly of the housing device with slidable engagement 1, the production cost for the housing device with slidable engagement 1 can be reduced and the assembly steps can be simplified.

As shown in FIG. 2, in one embodiment, the fitting 20 may have an annular groove 21. The two clamping arms 31 of the sliding buckle 30 can correspondingly clamp into the annular groove 21. Hence, the annular groove 21 of the fitting 20 is provided to prevent the fitting 20 from being detached from the two clamping arms 31 easily, and to further improve the fixing results of the fitting 20.

As shown in FIGS. 2 to 4, in one embodiment, an end portion of each of the clamping arms 31 of the sliding buckle 30 may be provided with a reverse hook member 311. Therefore, when the two clamping arms 31 clamp to the outside of the fitting 20, the reverse hook members 311 are engaged with the fitting 20 for improving the fixing of the fitting 20. Hence, the reverse hook members 311 are provided to prevent the fitting 20 from being detached from the two clamping arms 31 easily.

As shown in FIGS. 3 and 4, in one embodiment, the sliding buckle 30 may be provided with at least one cable-organizing groove 33 (in this embodiment, the sliding buckle 30 is provided with two cable-organizing grooves 33 at two opposite sides of the sliding groove 32). Therefore, the cable(s) in the housing body 10 can be received in the cable-organizing groove 33 (as shown in FIG. 4). Hence, the cable(s) can be arranged orderly and be kept unwound to increase the convenience of the assembly procedure.

Figure 5:
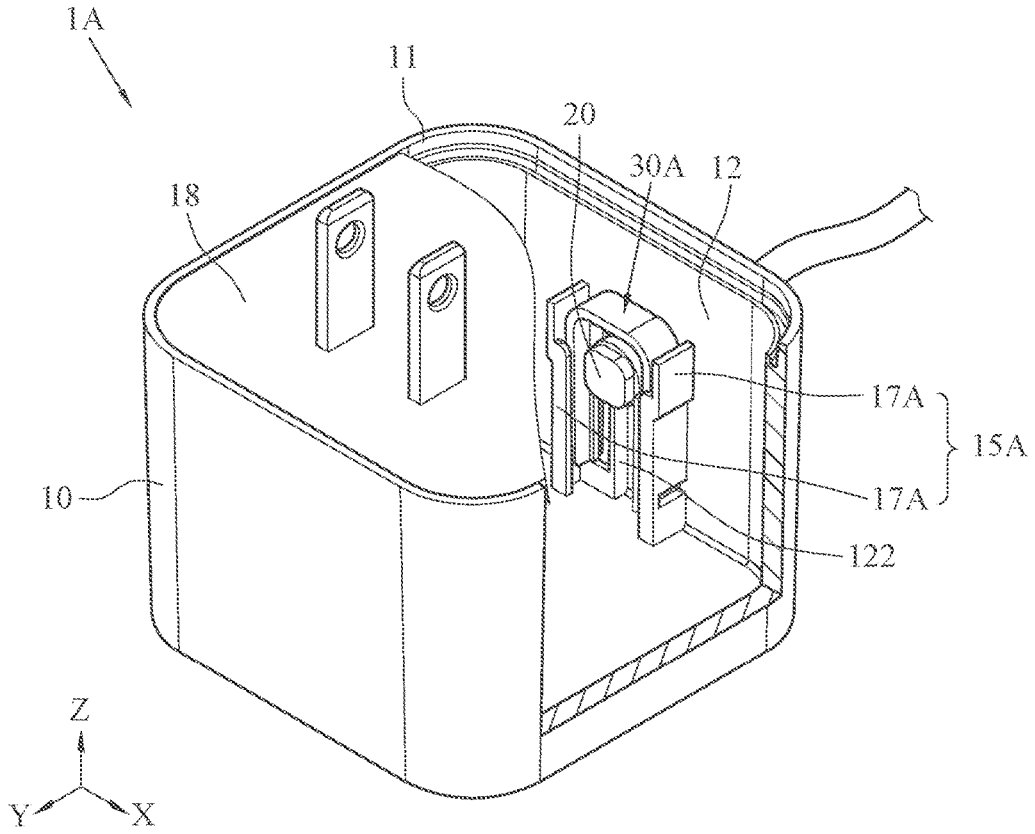
FIG. 5 illustrates a perspective view of a housing device with slidable engagement according to a second embodiment of the instant disclosure.
Figure 6:
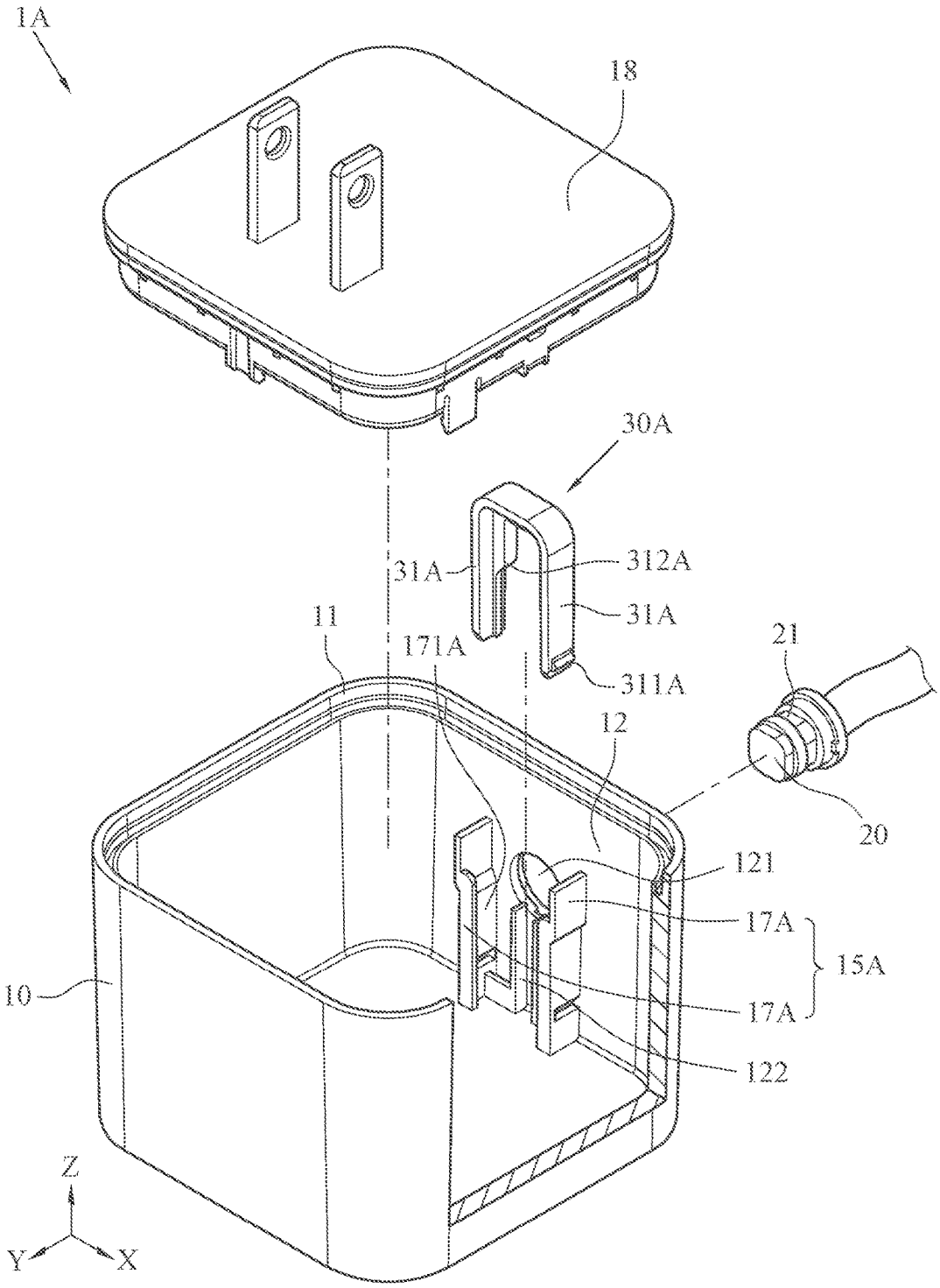
FIG. 6 illustrates an exploded view of the housing device with slidable engagement according to the second embodiment.

FIGS. 5 to 8 respectively illustrate a perspective view, an exploded view, an assembled view, and a sectional view of a housing device with slidable engagement 1A according to a second embodiment of the instant disclosure. As shown in FIGS. 5 and 6, in this embodiment, the guide structure 15A of the housing device with slidable engagement 1A comprises two guiding rails 17A, and the two guiding rails 17A are respectively assembled on two opposite sides of the through hole 121. In this embodiment, the two guiding rails 17A are elongated protruding blocks and aligned parallel with each other, but embodiments are not limited thereto. In some other embodiments, the two guiding rails 17A may be two rails with recessed shape.

As shown in FIGS. 5 and 6, in some embodiments, the two guiding rails 17A may be assembled on the inner surface of the lateral 12. For example, when the housing body 10 is a plastic shell, the two guiding rails 17A may be plastic rails or metal rails, and the rails may be assembled on the inner surface of the lateral 12 of the housing body 10 through adhering, hot-melting, locking, or other ways. Alternatively, the two guiding rails 17A and the housing body 10 may be an integrated structure. For example, the two guiding rails 17A and the housing body 10 are formed as an integral component by injection moulding.

As shown in FIGS. 5 and 6, the sliding buckle 30A of the housing device with slidable engagement 1A is slidably assembled between the two guiding rails 17A, so that the sliding buckle 30A is slidable relative to the two guiding rails 17A. For example, in this embodiment, the sliding buckle 30A is a U-shaped block and has two clamping arms 31A aligned parallel with each other, and the sliding buckle 30A is between the two guiding rails 17A, so that outer sides of the two clamping arms 31A are respectively attached to the two guiding rails 17A to limit the sliding buckle 30A (for example, in this embodiment, the sliding buckle 30A is limited in the X-axis direction). Moreover, when the sliding buckle 30 is forced, the sliding buckle 30A can be slidably moved along the two guiding rails 17A (for example, in this embodiment, the sliding buckle 30A can be slidably moved in the Z-axis direction), so that the sliding buckle 30A can be moved toward the opening side 11 or toward the inside of the housing body 10.

As shown in FIGS. 5 and 6, in this embodiment, an inner side of each of the guiding rails 17A has a guiding groove 171A, and the two clamping arms 31A of the sliding buckle 30A are respectively received in the two guiding grooves 171A. Therefore, the sliding buckle 30A can be further limited in the Y-axis direction to prevent the sliding buckle 30A from being detached from the two guiding rails 17A upon sliding.

Figure 7:
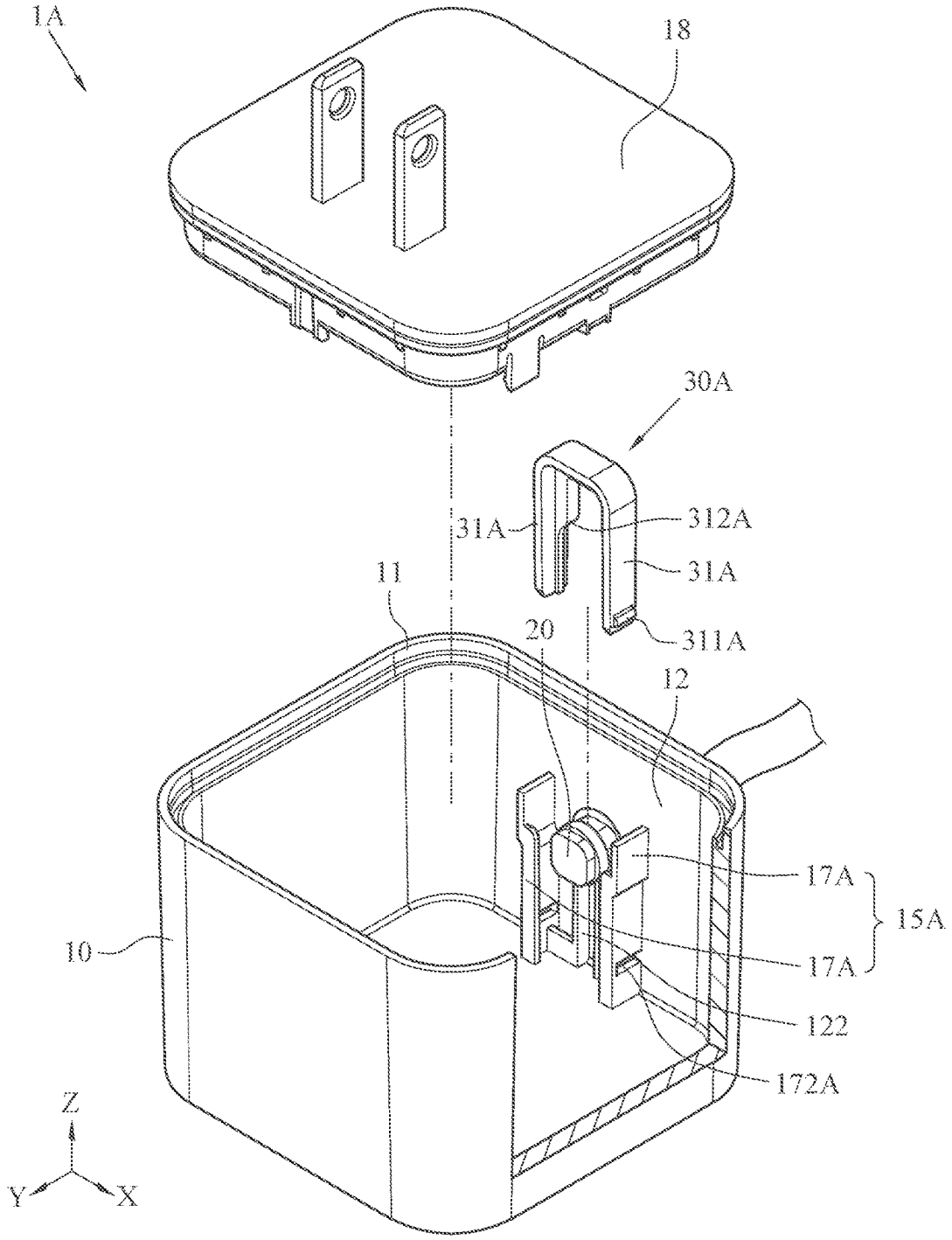
FIG. 7 illustrates an assembled view of the housing device with slidable engagement according to the second embodiment.
Figure 8:
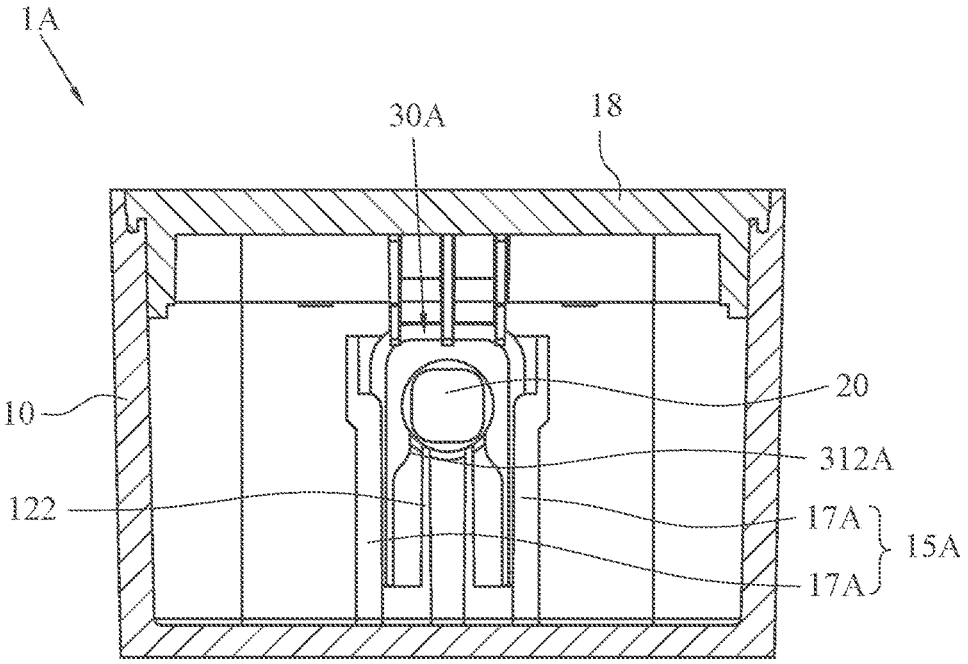
FIG. 8 illustrates a sectional view of the housing device with slidable engagement according to the second embodiment.

As shown in FIGS. 6 to 8, in the assembly procedure, firstly, the operator can insert the fitting 20 into the housing body 10 through the through hole 121, and insert the sliding buckle 30A between the two guiding rails 17A from the opening side 11. One end of each of the guiding rails 17A is adjacent to the opening side 11 of the housing device with slidable engagement 1A, so that the operator can assemble the housing body 10 with the sliding buckle 30A in a much easier manner. Next, the operator can apply force to operate the sliding buckle 30A (e.g., the operator may push one end of the sliding buckle 30A adjacent to the opening side 11) continuously sliding toward the fitting 20. Therefore, the two clamping arms 31A of the sliding buckle 30A can clamp to the outside of the fitting 20. As a result, the fitting 20 can be fixed in the housing body 10 (as shown in FIGS. 5 and 8), and the fitting 20 can be prevented from being detached from the housing body 10 due to improper pulling operation. Conversely, when the fitting 20 is to be detached from the housing body 10, the operator can apply force to operate the sliding buckle 30A sliding away from the fitting 20. For example, the operator can hold one end of the sliding buckle 30A adjacent to the opening side 11 and apply force to the sliding buckle 30A in a direction away from the fitting 20, so that the sliding buckle 30A can be detached from the fitting 20.

As shown in FIGS. 6 to 8, in one embodiment, an inner side of each of the clamping arms 31A of the sliding buckle 30A is provided with a guide surface 312A (here, the guide surface 312A is a curved surface). When the sliding buckle 30A slides toward the fitting 20, the fitting 20 abuts against the two clamping arms 31A outwardly along the guide surface 312A, so that the two clamping arms 31A are expanded outwardly to clamp to the outside of the fitting 20 in a stronger manner.

As shown in FIGS. 6 to 8, in one embodiment, the opening side 11 of the housing device with slidable engagement 1A may be provided with a cover 18 to allow the housing body 10 to be in a closed state. The cover 18 may be braced against one end of the sliding buckle 30A adjacent to the opening side 11. Therefore, the sliding buckle 30A is not slid freely due to the cover 18 and can stably clamp to the outside of the fitting 20.

As shown in FIGS. 6 to 8, in one embodiment, a buckling member 311A may protrude from an outer side of each of the clamping arms 31A of the sliding buckle 30A (here, the buckling member 311A is a protruding block protruding from an end portion of each of the clamping arms 31A). When the two clamping arms 31A clamp to the outside of the fitting 20, the buckling members 311A are respectively buckled into two buckling grooves 172A at the inner sides of the guiding rails 17A to further improve the fixing results of the sliding buckle 30A.

As shown in FIGS. 6 to 8, in one embodiment, a limiting block 122 further protrudes from an inner surface of the lateral 12 of the housing body 10. The limiting block 122 is located between the two clamping arms 31A and braces against the fitting 20 to improve the fixing of the fitting 20 and to prevent the fitting 20 from being detached from the sliding buckle 30A. As shown in FIG. 8, in this embodiment, the limiting block 122 braces against one side of the fitting 20 which is not clamped by the two clamping arms 31A for preventing the fitting 20 from being detached from the sliding buckle 30A due to pulling.

Figure 9:
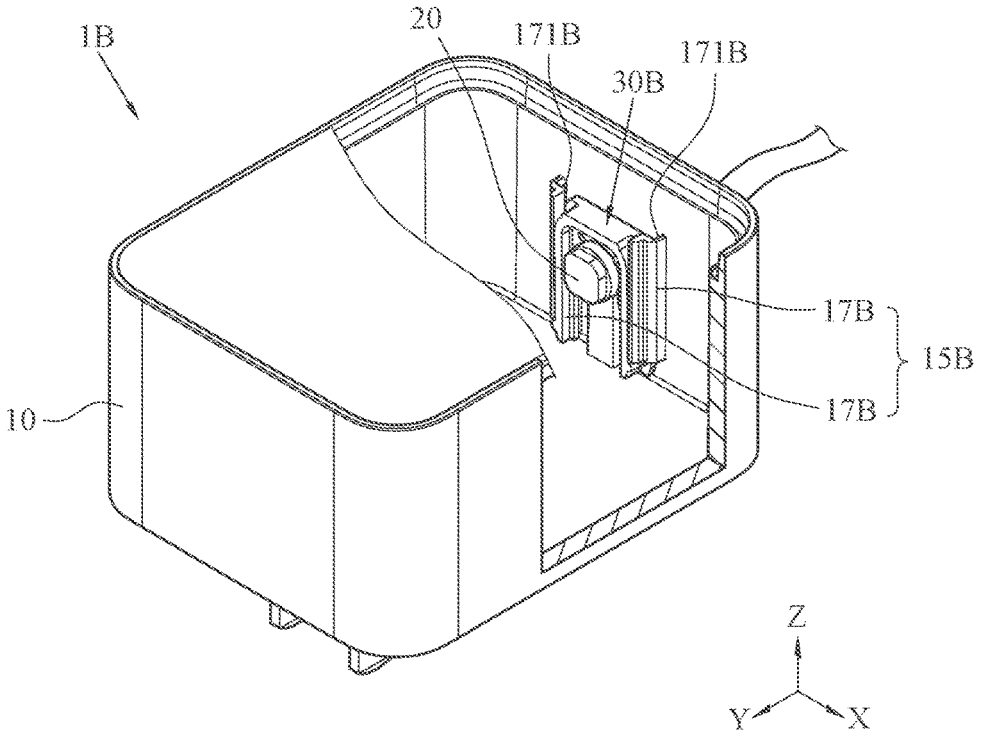
FIG. 9 illustrates a perspective view of a housing device with slidable engagement according to a third embodiment of the instant disclosure.
Figure 10:
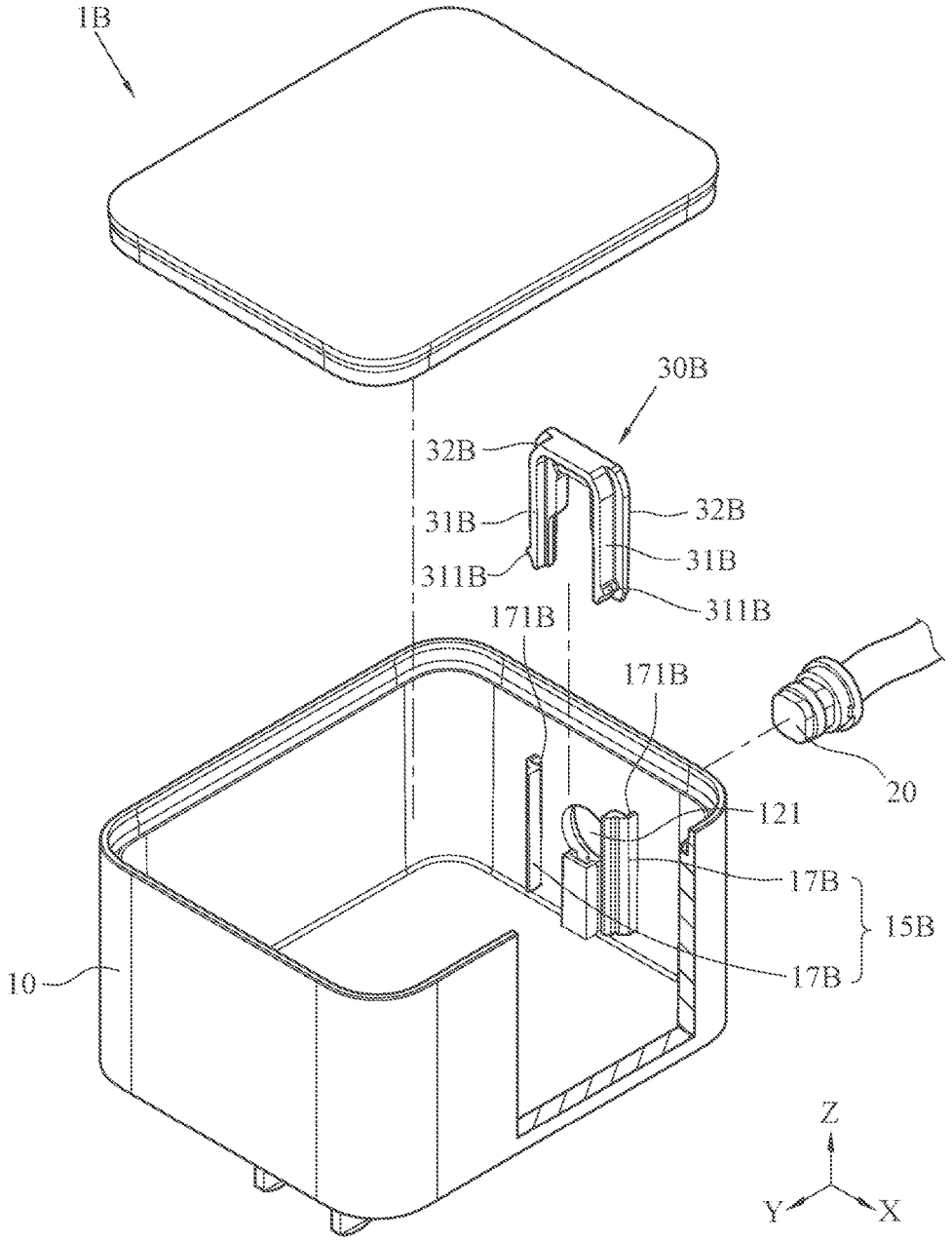
FIG. 10 illustrates an exploded view of the housing device with slidable engagement according to the third embodiment.
Figure 11:
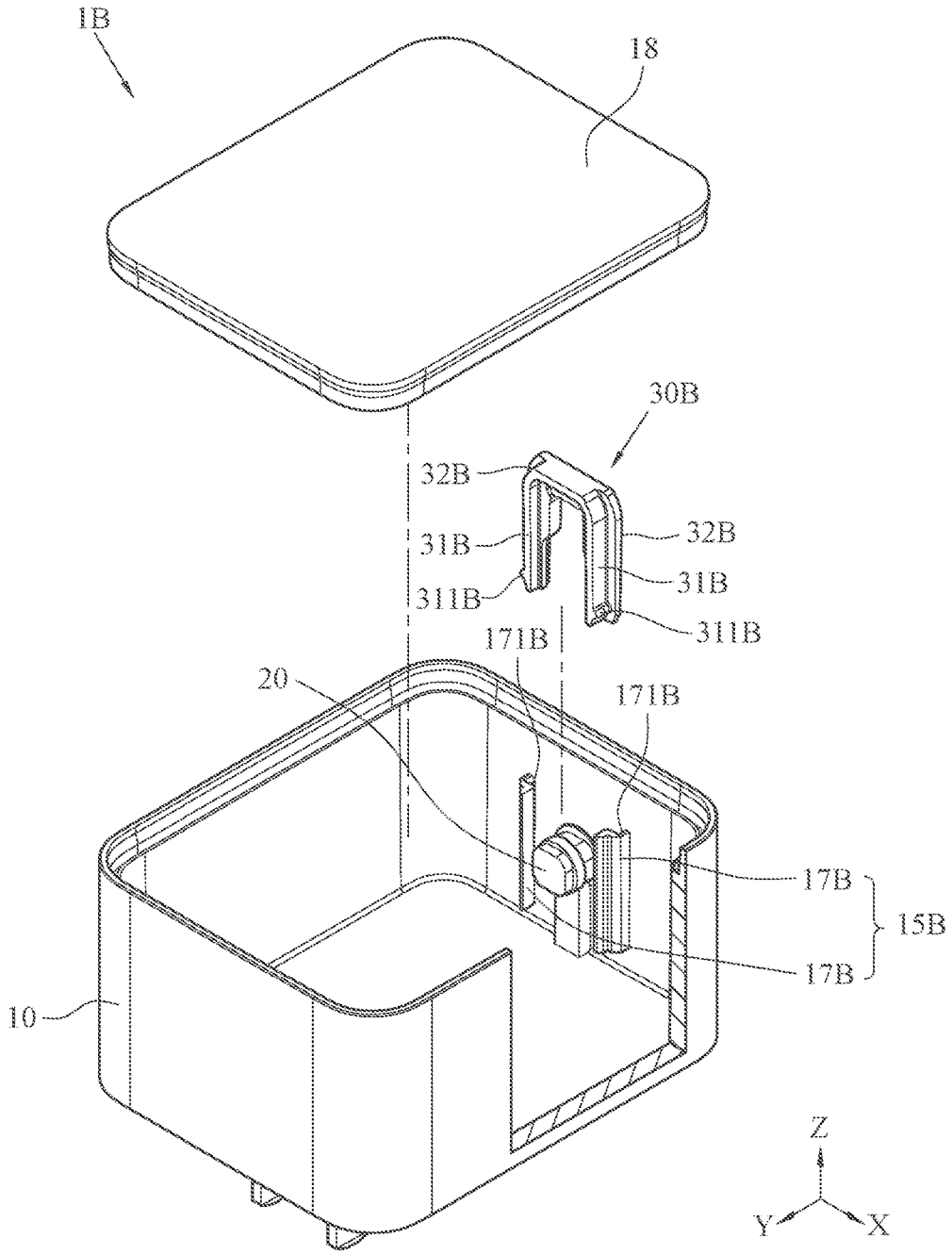
FIG. 11 illustrates an assembled view of the housing device with slidable engagement according to the third embodiment.

FIGS. 9 to 12 respectively illustrate a perspective view, an exploded view, an assembled view, and a sectional view of a housing device with slidable engagement 1B according to a third embodiment of the instant disclosure. As shown in FIGS. 9 and 10, in this embodiment, the guide structure 15B of the housing device with slidable engagement 1B comprises two guiding rails 17B, and the two guiding rails 17B are assembled on two opposite sides of the through hole 121. A sliding buckle 30B is assembled between the two guiding rails 17B, so that the sliding buckle 30B is slidable relative to the two guiding rails 17B. In this embodiment, as compared with the second embodiment, an inner side of each of the guiding rails 17B has a guiding groove 171B, a sliding block 32B protrudes from an outer side of each of the clamping arms 31B of the sliding buckle 30B, and the two sliding blocks 32B are respectively received in the guiding grooves 171B. That is, as shown in FIGS. 10 and 11, in the assembly procedure, an operator inserts the fitting 20 into the housing body 10 through the through hole 121, and then inserts the two sliding blocks 32B of the sliding buckle 30B into the two guiding grooves 171B of the two guiding rails 17B from the opening side 11. Therefore, the sliding buckle 30B can be limited in both the X-axis direction and the Y-axis direction, and the sliding buckle 30B can be slidable in the Z-axis direction when the sliding buckle 30B is forced.

Figure 12:
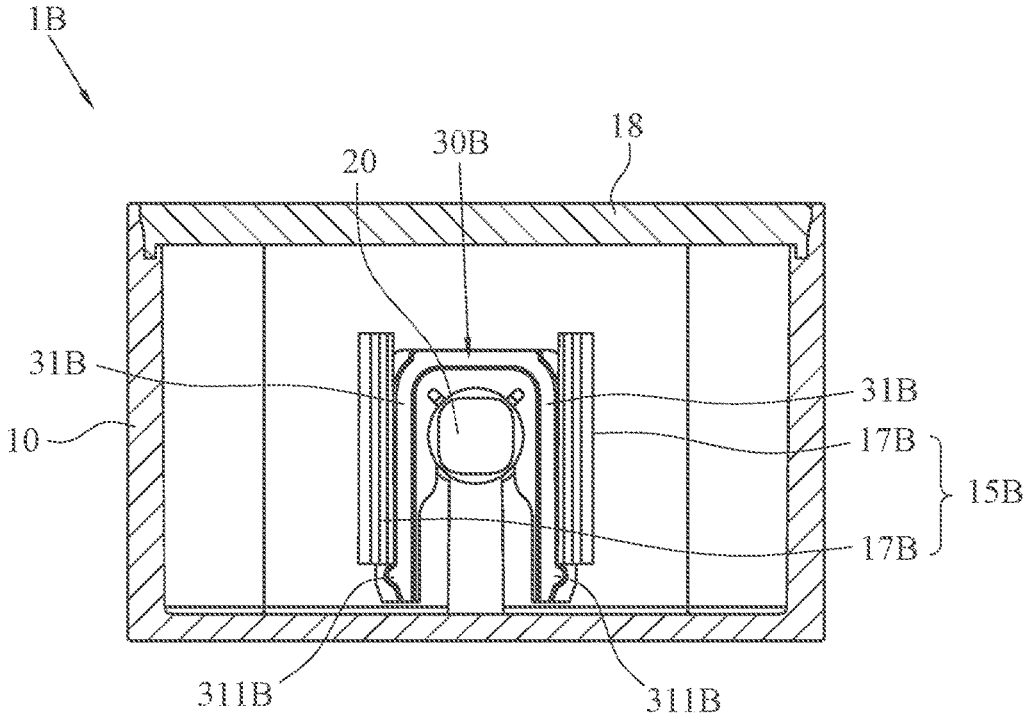
FIG. 12 illustrates a sectional view of the housing device with slidable engagement according to the third embodiment.

As shown in FIG. 12, in one embodiment, a buckling member 311B may protrudes from an outer side of each of the clamping arms 31B of the sliding buckle 30B (here, the buckling member 311B is a protruding block protruding from an end portion of each of the clamping arms 31B). When the two clamping arms 31B of the sliding buckle 30B clamp to the outside of the fitting 20, the buckling members 311B are respectively buckled to end portions of the guiding rails 17B to further improve the fixing of the sliding buckle 30B.

According to one or some embodiments of the instant disclosure, the sliding rail is slidably assembled with the guide structure to fix or release the fitting, so that the assembly of the housing device with slidable engagement can be performed in a convenient, rapid, and easy manner. For example, when the fitting is located at the interior portion of the housing body, the operator cannot insert his or her hands into the housing body for performing the assembly, and the operator may need special fixtures for the assembly; while in this embodiment, the operator just needs to apply force to operate the sliding buckle sliding toward the fitting for achieving the rapid assembly of the fitting with the housing body. Accordingly, since the operator does not need any additional tools for the assembly of the housing device with slidable engagement, the production cost of the housing device with slidable engagement can be reduced and the assembly steps can be simplified.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A housing device with slidable engagement, comprising:

a housing body comprising an opening side and a lateral adjacent to the opening side, wherein the lateral has a through hole, and an inner surface of the lateral is provided with a guide structure;

a fitting inserted into the housing body through the through hole; and a sliding buckle slidably assembled on the guiding structure, wherein the sliding buckle comprises two clamping arms, and the two clamping arms correspondingly clamp to an outside of the fitting;

wherein the guide structure comprises a sliding rail, the sliding buckle is provided with a sliding groove, and the sliding buckle is slidably assembled with the sliding rail by the sliding groove.

2. The housing device with slidable engagement according to claim 1, wherein the fitting is a cable strain relief.

3. A housing device with slidable engagement, comprising:

a housing body comprising an opening side and a lateral adjacent to the opening side, wherein the lateral has a through hole, and an inner surface of the lateral is provided with a guide structure;

a fitting inserted into the housing body through the through hole; and a sliding buckle slidably assembled on the guiding structure, wherein the sliding buckle comprises two clamping arms, and the two clamping arms correspondingly clamp to an outside of the fitting;

wherein the guide structure comprises two guiding rails assembled on two opposite sides of the through hole, and the sliding buckle is slidably assembled between the two guiding rails.

4. The housing device with slidable engagement according to claim 1, wherein the sliding rail comprises a first end and a second end opposite to the first end, the first end is adjacent to the opening side, and the second end is adjacent to the through hole.

5. The housing device with slidable engagement according to claim 3, wherein a limiting block further protrudes from an inner surface of the lateral, the limiting block is located between the two clamping arms and braces against the fitting.

6. The housing device with slidable engagement according to claim 1, wherein an end portion of each of the clamping arms is further provided with a reverse hook member.

7. The housing device with slidable engagement according to claim 3, wherein the fitting has an annular groove, and the two clamping arms clamp into the annular groove.

8. The housing device with slidable engagement according to claim 3, wherein the opening side is further provided with a cover braced against the sliding buckle.

9. The housing device with slidable engagement according to claim 1, wherein the fitting has an annular groove, and the two clamping arms clamp into the annular groove.

10. The housing device with slidable engagement according to claim 3, wherein an inner side of each of the clamping arms is further provided with a guide surface.

11. The housing device with slidable engagement according to claim 1, wherein the sliding buckle is further provided with a cable-organizing groove.

12. The housing device with slidable engagement according to claim 3, wherein an end portion of each of the clamping arms is further provided with a reverse hook member.

13. The housing device with slidable engagement according to claim 3, wherein the fitting is a cable strain relief.

* * * * *